US005537924A

United States Patent [19]

Krause

[11] Patent Number: 5,537,924

[45] Date of Patent: Jul. 23, 1996

[54] SHIFTING OF WASHING DEVICE WITHIN ITS HOUSING

[75] Inventor: Detley Krause, Leimen, Germany

[73] Assignee: Heidelberger Druckmaschinen Aktiengesellschaft, Heidelberg, Germany

[21] Appl. No.: 255,423

[22] Filed: Jun. 8, 1994

[30] Foreign Application Priority Data

Jun. 9, 1993 [DE] Germany ..... 43 19 258.0

[51] Int. Cl.[6] ..... B41F 35/00

[52] U.S. Cl. ..... 101/423; 101/416.1; 101/425

[58] Field of Search ..... 101/423, 424, 101/425, 148, 416.1

[56] References Cited

U.S. PATENT DOCUMENTS

| | | | |
|---|---|---|---|
| 4,344,361 | 8/1982 | Mac Phee et al. . | |
| 4,651,644 | 3/1987 | Kaempfe et al. | 101/423 |
| 4,922,821 | 5/1990 | Nazaka et al. | 101/425 |
| 4,981,078 | 1/1991 | Dettinger et al. | 101/424 |
| 4,991,507 | 2/1991 | Nozaka et al. | 101/425 |
| 5,105,740 | 4/1992 | Loos et al. . | |
| 5,150,650 | 9/1992 | Murakami | 101/425 |
| 5,170,706 | 12/1992 | Rodi et al. | 101/148 |

FOREIGN PATENT DOCUMENTS 3909119 9/1990 Germany .

*Primary Examiner*—Ren Yan
*Assistant Examiner*—Lynn D. Hendrickson
*Attorney, Agent, or Firm*—Nils H. Ljungman & Associates

[57] ABSTRACT

A printing press having one or more printing stands, wherein such a printing stand includes: a plate cylinder for having mounted thereon a printing plate; an inking unit which includes ink applicator rollers for applying ink to the printing plate; a blanket cylinder for receiving an ink impression from the printing plate; a drum for carrying a printed sheet; and a washing device for removing dirt particles adhering to the outer cylindrical surfaces of the cylinders involved in the printing process. The washing device comprises a supply roll on which the clean washcloth is wound up, a pressing-on element for pressing the washcloth on the cylinder to be cleaned, a subsequent take-up roll for taking up the dirty washcloth, side parts receiving the rolls and the pressing-on element on both sides thereof, and a drive mechanism for conveying the washcloth.

18 Claims, 4 Drawing Sheets

SHIFTING OF WASHING DEVICE WITHIN ITS HOUSING

BACKGROUND OF THE INVENTION

1. Field of the Invention

The present invention generally relates to a rotary printing press which may have one or more printing stands, or printing units. Such a printing stand may typically include a plate cylinder for having mounted thereon a printing plate, an inking unit which includes ink applicator rollers for applying ink to the printing plate, a blanket cylinder for receiving an ink impression from the printing plate, and a drum for carrying a printed sheet, onto which the ink impression carried by the blanket cylinder is transferred. A duct roller is typically mounted adjacent to an ink duct. Typically, ink is transferred from the duct roller to the inking unit by means of a vibrator roller which oscillates to successively pick up ink from the duct roller and deposit the same on an a roller of the inking unit. Typically, the printing stand will also include auxiliary mechanisms such as, for example, a duct roller drive, a vibrator roller drive, and applicator roller throw-off for lifting the ink applicator rollers off of the printing plate, a press drive and a sheet feed for supplying the sheets to be printed to the sheet drum.

The present invention essentially also relates, more particularly, to a printing press which has included therein a washing device for removing dirt particles adhering to the outer cylindrical surfaces of the cylinders involved in the printing process. Such a washing device may comprise a supply roll on which a clean washcloth can be wound, a pressing-on element for pressing the washcloth into contact with the cylinder to be cleaned, a following take-up roll for taking up the dirty washcloth, side parts receiving the rolls and the pressing-on element on both sides thereof, and a drive mechanism for conveying the washcloth.

2. Background Information

A washing device such as that discussed above is known from Federal Republic of Germany Patent No. 39 09 119 A1, in which the known embodiment is designed as a slide-in unit. A disadvantage of this known embodiment may be found in that, once the clean washcloth has been used, the dirty washcloth on the take-up roll must essentially be rewound back onto the supply roll in order for the dirty washcloth to be removed. Rewinding the washcloth may cause problems, since the layers of the dirty washcloth wound on the take-up roller can tend to stick together very easily, thus hindering the rewinding process.

OBJECT OF THE INVENTION

Proceeding from the facts set forth above, it is an object of the present invention to enable the changing of the washcloth in a washing device without having to rewind the used washcloth.

SUMMARY OF THE INVENTION

According to the present invention, this object can be achieved in that the supply roll and the take-up roll are preferably mounted in the side parts so as to be pivotable, in a common center of rotation, about 180° such that both rolls can essentially change working positions so that the empty supply roll can then subsequently be used to take up dirty washcloth. Thus, this solution essentially permits removal of the dirty washcloth roll from the washing device and its replacement via the insertion of a new supply roll, wherein the new supply roll has a clean washcloth. This essentially generally facilitates the operation of the washing device, and the roll-changing process is reduced essentially by virtue of not having to rewind the used washcloth.

An advantageous embodiment of the invention is characterized in that both rolls preferably feature coupling means for the drive of the rolls and that, on both sides of the rolls, the rolls are preferably mounted in a respective bearing body which, in turn, is pivot-mounted in the side parts. Additionally, when in its working position, the respective take-up roll can preferably be coupled to the drive mechanism, and, with the rolls being in their working positions, the bearing bodies can preferably be latched in the side parts via pawls. The bearing bodies can preferably be pivoted manually or via drive means so that the pressman can simply withdraw the washing device from the working position, pivots the bearing bodies about approximately 180°, and exchange the used washcloth for a new supply roll. As soon as the washing device has been slid again into its working position, a respective cylinder can be washed in a known manner.

In summary, one aspect of the invention resides broadly in a printing press comprising: a frame; a plate cylinder being rot drably mounted on the free; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; a blanket cylinder being rotatably mounted on the frame and having means for being engaged with the plate cylinder during operation of the printing press; means for washing a predetermined one of the following cylinders and rollers: the blanket cylinder; the plate cylinder; and one of the inking rollers; each of the blanket cylinder, the plate cylinder, and the plurality of inking rollers having an external surface; the washing means comprising: a holding location for accommodating an initial supply of washcloth and holding the supply of washcloth at the holding location, the washcloth for being applied to the external surface of the predetermined cylinder or roller, for washing the external surface of the predetermined cylinder or roller; means for paying out washcloth from the holding location; means for applying washcloth, having been paid out from the holding location, onto the external surface of the predetermined cylinder or roller, to wash the external surface of the predetermined cylinder or roller; a receiving location for receiving washcloth, having been paid out from the holding location and having been applied to the external surface of the predetermined cylinder or roller, and for accumulating the received washcloth at the receiving location; and means for shifting a predetermined portion of the received washcloth, while wrapped in a roll that has been accumulated at the receiving location, from the receiving location to a different location; and means for providing accessibility of the predetermined portion of received washcloth at the different location, to permit removal of the predetermined portion of received washcloth from the washing means.

Another aspect of the invention resides broadly in a washing apparatus for a printing press, for washing a predetermined one of the following cylinders and roller: a blanket cylinder in a printing press, a plate cylinder in a printing press, and one of a plurality of inking rollers in a printing press; each of the blanket cylinder, the plate cylinder, and the plurality of inking rollers having an external surface; the washing apparatus comprising: means for attaching the washing apparatus to a printing press, the printing press having a substantial area rendering removal of solid cleaning means from the washing apparatus substantially inaccessible; means for holding a supply of solid cleaning means, which cleaning means is for being applied to the external surface of the predetermined cylinder or roller in a printing press, for cleaning the external surface of the predetermined cylinder or roller; means for transporting the solid cleaning means from the holding means to the predetermined cylinder or roller in a printing press; means for applying the solid cleaning means, having been transported from the holding means, onto the external surface of the predetermined cylinder or roller of the printing press, to clean the external surface of the predetermined cylinder or roller; means for receiving cleaning means having been transported from the first roll means and having been applied to the external surface of the predetermined cylinder or roller of the printing press; and means for permitting the receiving means to be accessible, upon receipt of a predetermined portion of the cleaning means by the receiving means, to permit removal, from the printing press, of the predetermined portion of the cleaning means directly from the receiving means.

Yet another aspect of the invention resides broadly in a method of operating a printing press, such a printing press comprising: a frame; a plate cylinder being rotatably mounted on the frame; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; and a blanket cylinder being rotatably mounted on the free and having means for being engaged with the plate cylinder during operation of the printing press; the method comprising the steps of: providing a frame; providing a plate cylinder and rotatably mounting the same on the free; providing an ink reservoir for holding a supply of ink; providing an inking mechanism for transferring the ink between the ink reservoir and the plate cylinder during operation of the printing press; said step of providing the inking mechanism comprising the step of providing a plurality of inking rollers for transferring ink from the ink reservoir to the plate cylinder; providing a blanket cylinder and rotatably mounting the same on the frame; the step of providing the blanket cylinder comprising the step of providing means for being engaged with the plate cylinder during operation of the printing press; providing means for washing a predetermined one of the following cylinders and rollers: the blanket cylinder; the plate cylinder; and one of the inking rollers; configuring each of the blanket cylinder, the plate cylinder, and the plurality of inking rollers to have a external surface; the step of providing the washing means comprising the steps of: providing a holding location for accommodating an initial supply of washcloth and for holding the supply of washcloth at the holding location, the washcloth for being applied to the external surface of the predetermined cylinder or roller, for washing the external surface of the predetermined cylinder or roller; providing means for paying out washcloth from the holding location; providing means for applying washcloth, having been paid out from the holding location, onto the external surface of the predetermined cylinder or roller, to wash the external surface of the predetermined cylinder or roller; providing a receiving location for receiving washcloth, having been paid out from the holding location and having been applied to the external surface of the predetermined cylinder or roller, and for accumulating the received washcloth at the receiving location; providing means for shifting a predetermined portion of the received washcloth, while wrapped in a roll that has been accumulated at the receiving location, from the receiving location to a different location; and providing means for providing accessibility of the predetermined portion of received washcloth at the different location, to permit removal of the predetermined portion of received washcloth from the washing means; the method further comprising the additional steps of: washing a predetermined one of the following cylinders and rollers: the blanket cylinder; the plate cylinder; and one of the inking rollers; the washing step comprising the steps of: accommodating an initial supply of washcloth, and holding the supply of washcloth at the holding location; paying out washcloth from the holding location with the means for paying out; with the applying means, applying washcloth, having been paid out from the holding location, onto the external surface of the predetermined cylinder or roller, to wash the external surface of the predetermined cylinder or roller; receiving washcloth, having been paid out from the holding location and having been applied to the external surface of the predetermined cylinder or roller, at the receiving location; accumulating the received washcloth at the receiving location; shifting, with the shifting means, a predetermined portion of the received washcloth, while wrapped in a roll that has been accumulated at the receiving location, from the receiving location to a different location; and accessing, by way of the means for providing accessibility, the predetermined portion of received washcloth at the different location, and subsequently removing the predetermined portion of received washcloth from the washing means.

BRIEF DESCRIPTION OF THE DRAWINGS

A specimen embodiment of the present invention is schematically illustrated in the drawings, wherein.

DESCRIPTION OF THE PREFERRED EMBODIMENT

Figure 1:
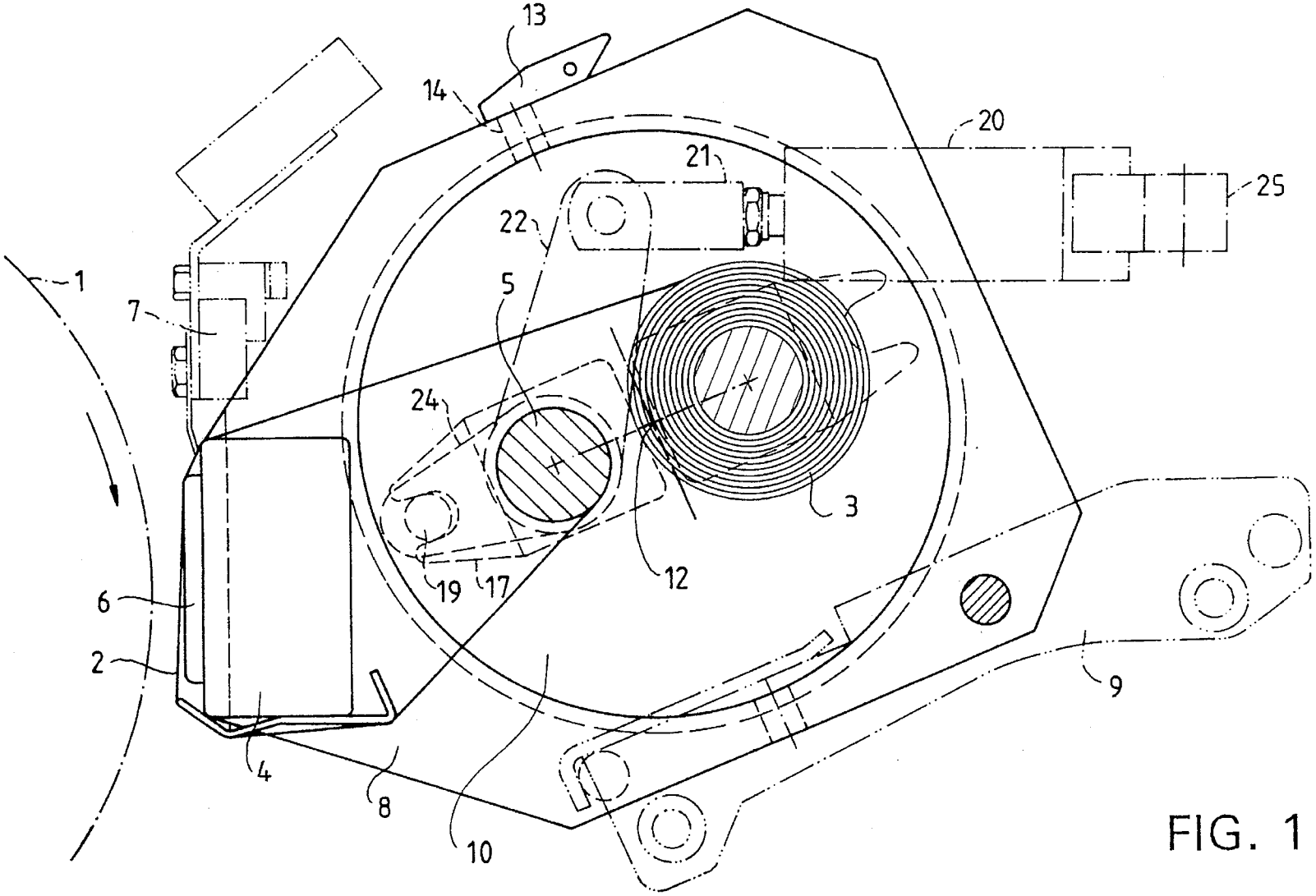
FIG. 1 is a side elevational view of the washing device.
Figure 1A:
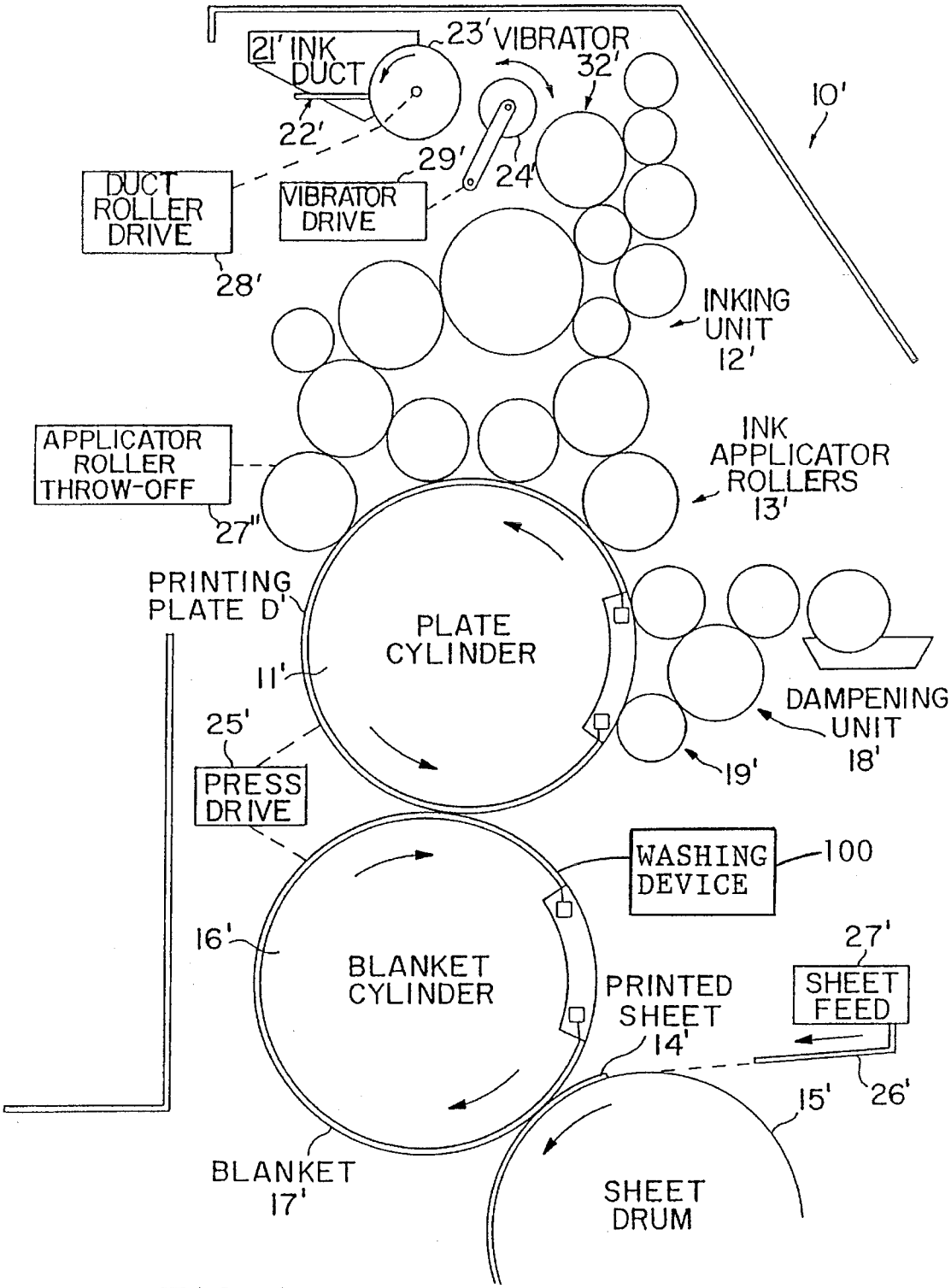
FIG. 1*a* illustrates a printing press in which a washing device according to the present invention may be employed.

FIG. 1*a* illustrates a rotary print stand 10' of a rotary printing press which can employ a washing device according to the present invention. Rotary print stand 10' generally includes: a plate cylinder 11' for having mounted thereon a printing plate D'; an inking unit 12' which includes ink applicator rollers 13' for applying ink to the printing plate an ink profile; a dampening (or wetting) unit 18' having dampening applicator rollers 19' for transferring a dampening agent to the printing plate, a blanket cylinder 16' carrying a rubber blanket 17' for receiving an ink impression from the printing plate, and a sheet drum 15' for carrying a printed sheet 14' onto which the ink impression carried by blanket 17' is transferred. A duct roller 23' is typically mounted adjacent to ink duct 21'. Typically, ink is transferred from duct roller 23' to inking unit 12' by means of a vibrator roller 24' which oscillates to successively pick up ink from duct roller 23' and deposit the see on a roller 32' of inking unit 10'. Typically, the printing stand 10' will also include auxiliary mechanisms such as, for example, a duct roller drive 28', a vibrator roller drive 29', an applicator roller throw-off 27" for lifting the ink applicator rollers 13' off of the printing plate, a press drive 25' and a sheet feed 27' for supplying the sheets to be printed 26' to sheet drum 15'.

FIG. 1*a* additionally illustrates a washing device 100 which, as shown, may preferably be incorporable into the printing stand 10' so as to be able to wash, for example, the blanket 17' of blanket cylinder 16'.

It should be understood that the components discussed hereinabove with relation to FIG. 1*a* may, if appropriate, essentially be considered to be interchangeable with similar components discussed herebelow with relation to FIGS. 1 through 3.

Turning now to FIG. 1, the cylinder 1, dash-dotted in FIG. 1, may essentially be considered to represent a blanket cylinder of an offset printing press which has to be washed at certain time intervals. In the specimen embodiment shown, a washcloth 2, which is wound from a supply roll 3, is preferably used to wash the outer cylindrical surface of the cylinder 1. The clean washcloth which is wound from the supply roll 3 is preferably guided over a pressing-on element 4 and is then preferably wound on a take-up roll 5. Each washing cycle essentially requires a certain length of the washcloth so that essentially only dirty washcloth is wound on the take-up roll 5.

During the washing process, a diaphragm part 6 on the pressing-on element 4 can preferably be supplied with compressed air so that the diaphragm 6 preferably arches outwards and presses the washcloth 2 against the outer cylindrical surface of the cylinder 1. The washing procedure may preferably be facilitated by a washing-medium dispenser device 7. Such a washing-medium dispenser device 7 may preferably be fixed to the frame of the printing press and may preferably include components, well-known to those of ordinary skill in the art, for dispensing washing medium or the like to the washcloth 2.

Generally, in accordance with a preferred embodiment of the present invention, it should be understood that diaphragm part 6 may preferably encompass any appropriate component for pressing washcloth 2 against the surface of the cylinder 1. Additionally, although reference is made hereinabove to a blanket cylinder for being washed, it should be understood that the cylinder 1 for being washed could conceivably be embodied by another cylinder or roller in the printing press, such as a plate cylinder or an inking unit roller.

Both sides of the pressing-on element 4 are preferably mounted in side parts 8 which, via a guide 9, may preferably be moved away from the cylinder 1. This facilitates the changing of the wound-up dirty washcloth for a new supply roll with a clean washcloth.

Thus, in accordance with a preferred embodiment of the present invention, a guide 9 may preferably be provided to facilitate removal of side-parts 8, and consequently substantially the entire washing device, from proximity to the cylinder 1. Such removal may be accomplished by sliding, for example. Appropriate means for facilitating such sliding are well-known to those of ordinary skill in the art and will not be further discussed herein.

Figure 2:
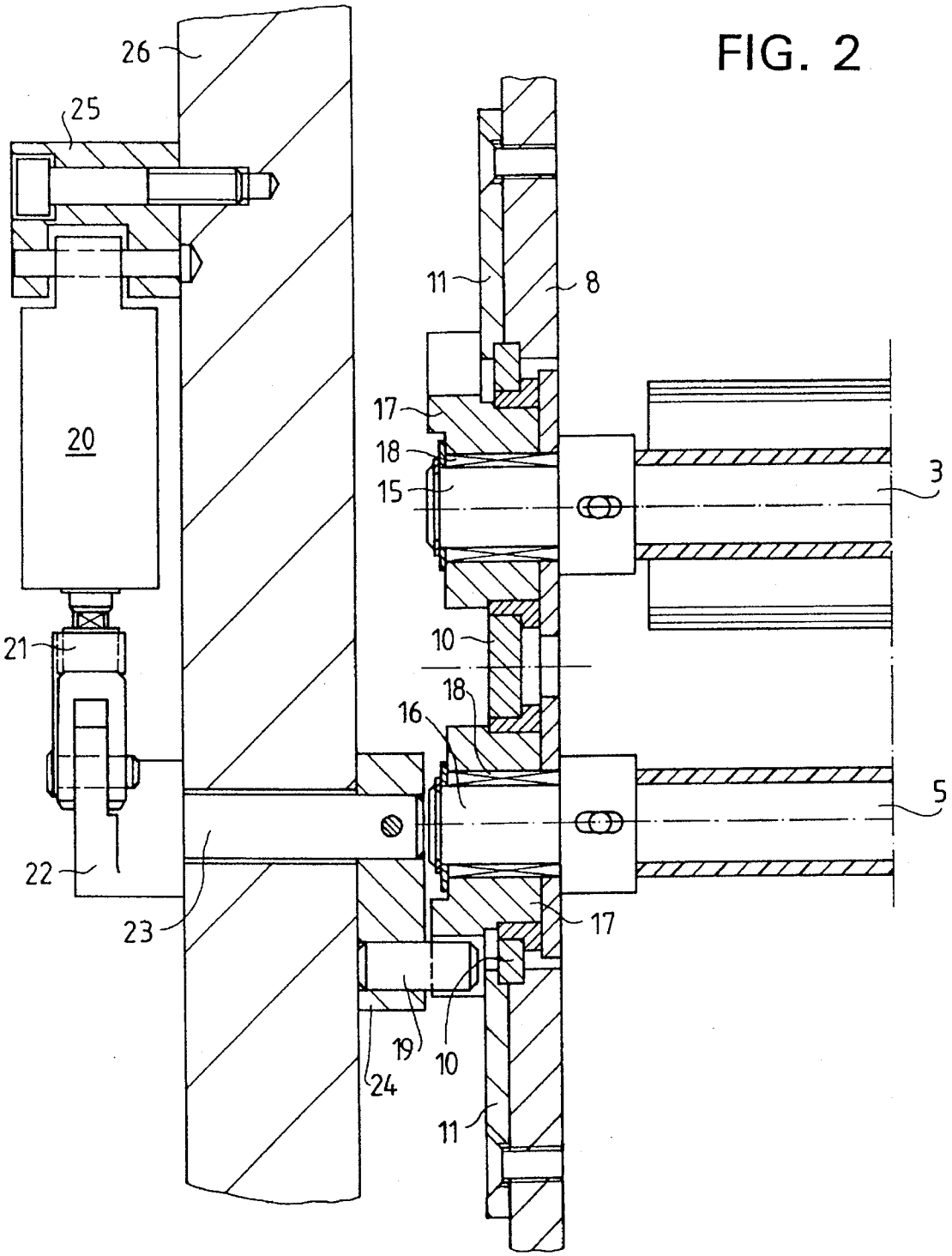
FIG. 2 is a fragmentary cross-sectional view of the washing device.

Bearing bodies 10, which are held by holding means 11, are preferably pivot-mounted in the side parts 8 (see FIG. 2). About a common center of rotation 12, the bearing bodies 10 can preferably be pivoted approximately 180°. Via pawls 13 the bearing bodies 10 can be latched by means of locking bolts 14 with respect to the side parts 8.

Conceivably, bearing bodies 10 could be configured to undergo only a limited rotational displacement, such as 180°, or could be configured to undergo an even greater rotational displacement, such as 270° or 360°. In each case, it is conceivable that appropriate stops could be provided to limit the rotational displacement of bearing bodies 10. Alternatively, bearing bodies 10 could be configured to undergo substantially unlimited rotational displacement.

It should be understood that types of latching devices other than the pawls 13 and locking bolts 14 disclosed herein could be utilized within the scope of the present invention to produce similar results.

The supply roll 3 and the take-up roll 5 are preferably each pivot-mounted, i.e. rotatably mounted, in a respective bearing body 10, and can have claws 17 being mounted, via one-way clutches 18, on the axle journals 15, 16 of the rolls 3, 5, respectively, such that, during the sliding in of the side parts 8, the respective claw 17 of the take-up roll 5 preferably embraces a pin 19. An advancing means 20 can be provided to actuate the piston rod 21 which, via a lever 22, pivots e drive journal 23 on which a swivelling lever 24, receiving the drive journal 19, is fixed. While the advancing means 20 performs a stroke in order to drive the washcloth, the take-up roll 5 can preferably be turned by a certain amount so that a clean portion of the washcloth 2 comes to lie on the diaphragm part 6. During the return stroke of the advancing means 20 the respective one-way clutch prevents the take-up roll 5 from being unwound.

Thus, a new section of the clean washcloth can preferably be used for each washing cycle, irrespectively of which roll serves as a take-up roll, due to pivoting of the bearing body 10, with a claw 17 having a one-way clutch 18 being provided for each roll. In the specimen embodiment shown, the advancing means 20, which essentially can be considered as being designed as a drive means, is preferably mounted on the machine side frame 26 via a bearing 25.

It should be appreciated that each bearing body 10, corresponding to a different side part 8, may be embodied by a circular disc or the like which is essentially rotatably mounted in the corresponding side part 8 to rotate about center 12. As such, an appropriate bearing arrangement may preferably be provided to ensure that each bearing body 10 is rotatably mounted in the corresponding side part 8. Such an arrangement could include, for example, roller bearings disposed at the outer periphery of the disc embodying each bearing body 10, or possibly a simple pivot connection located at the center of the disc embodying each bearing body 10, or possibly both.

The one-way clutches 18 illustrated in FIG. 2 are essentially only provided as an example, and could conceivably be replaced by a component performing a similar function. For example, to facilitate advancement of a roll 5 in a single rotational direction, a ratchet arrangement could conceivably be provided. Other types of advancing arrangements are generally well-known to those of ordinary skill in the art and will not be further discussed herein.

It should be understood that, when side-parts 8 of the washing device are slid into the printing press, and when the respective claw 17 of the take-up roll 5, for example, embraces a pin 19, the bearing bodies 10 will have already been locked with respect to side parts 8, by an appropriate locking arrangement, such as by the pawls 13 and locking bolts 14 illustrated in FIG. 2. Such locking is preferably configured to fix the rolls 3, 5 in position with respect to side-parts 8.

Advancing means 20 may preferably be embodied by e pneumatic or hydraulic piston-cylinder arrangement. Further, in accordance with at least one preferred embodiment of the present invention, the claw 17 for each roll 3, 5, could preferably be configured to be positionable between a first, rest position, corresponding to a fully retracted state of the piston-cylinder arrangement 20, and a second position, corresponding to an extended state of the piston-cylinder arrangement 20. In the second position, the claw 17, having received a force from pin 19 in order to undergo pivotal displacement, will have preferably traversed a sufficient amount to have advanced the washcloth 2 a desired amount. Upon retraction of the piston-cylinder arrangement 20, claw 17 will then preferably return to the first rest position, while, because of one-way clutch 18, the respective roll 3, 5 will essentially remain stationary.

Within the scope of the present invention, it is conceivable to provide a claw arrangement 17 only on one of the rolls 3, 5, and not on the other. In such an instance, it would be conceivable to slide side-parts 8 away from cylinder 1 upon termination of a washing operation and accumulation of dirty washcloth on the take-up roll 5, rotate bearing bodies 10 so as to essentially switch the positions of rolls 3 and 5, remove the dirty washcloth from roll 5, rotate bearing bodies back so as to again switch the positions of rolls 3 and 5, and then install a new supply of washcloth on roll 3. Thus, essentially only one of the rolls 3, 5 would be permanently designated as a supply roll and the other as a take-up roll, in contrast to the embodiments discussed heretofore, in which the rolls 3 and 5, each having a claw arrangement 17, are essentially interchangeable.

Additionally, within the scope of the present invention, it is conceivable to configure bearing bodies 10, as well as the washing device in general, such that the rolls 3 and 5 do not necessarily switch positions, per se, in order to remove a dirty washcloth. Particularly, it is conceivable to designate three or more, instead of two, possible positions for each of the rolls 3, 5, wherein, one position would correspond to a supply position, another would respond to a take-up position, and yet another would correspond to a removal position. Thus, instead of providing essentially only two positions as discussed heretofore, wherein, the supply position essentially coincides with a position from which a roll 3, 5 can be removed, it is possible to designate a third position solely as a position from which a roll 3, 5 can be removed.

Figure 3:
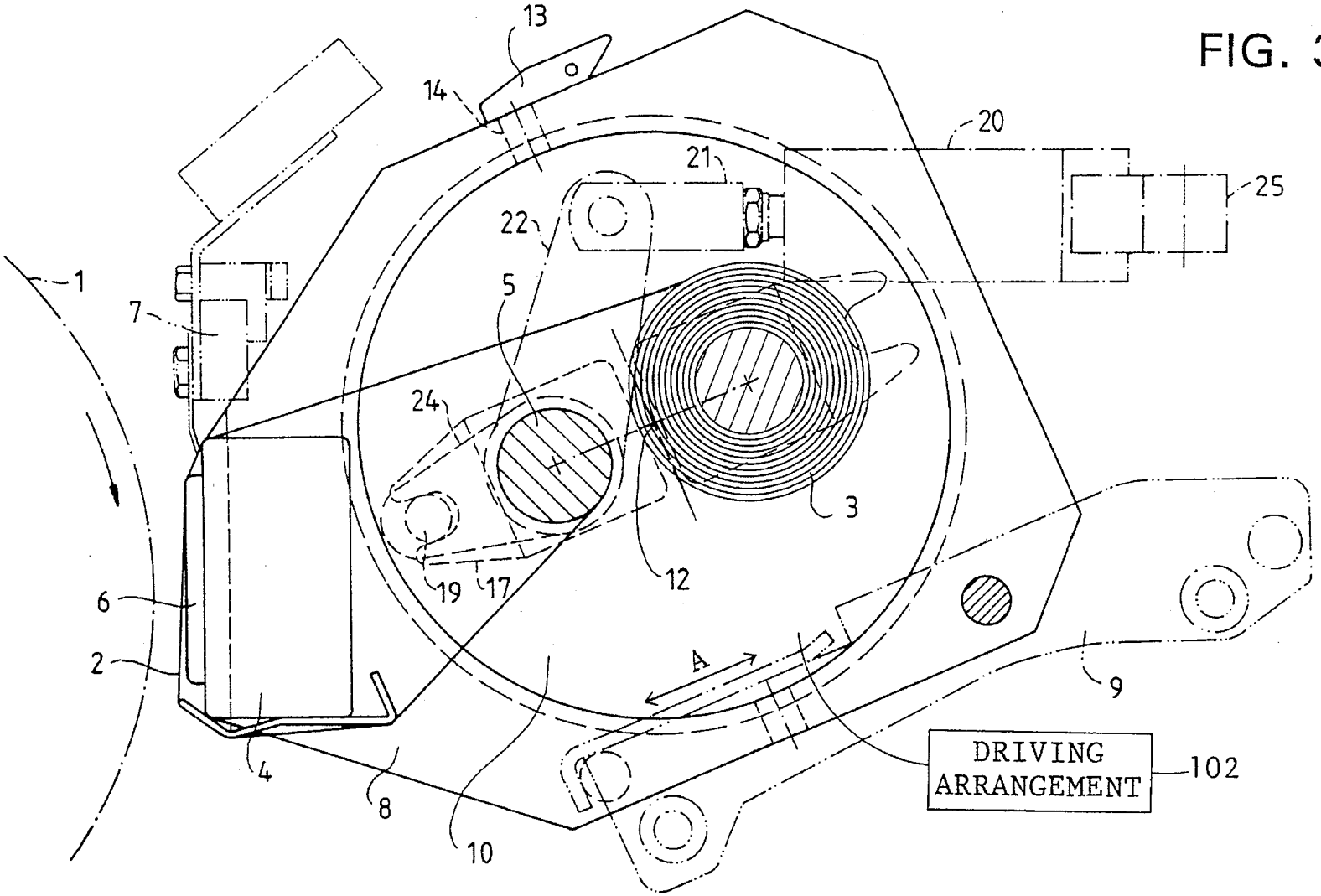
FIG. 3 is substantially the same view as FIG. 1, but more detailed.

FIG. 3 schematically illustrates a driving arrangement 102 for driving the bearing bodies 10. Generally, it should be understood that essentially any appropriate means could be employed to drive the bearing bodies 10 when it is desired that the supply roll 3 and take-up roll 5 switch places. For example, it is conceivable to employ a manually operable crank arrangement to be used once the washing device is slid away from the cylinder 1. Such a crank arrangement could conceivable be embodied by a short, handle-type stub extending from one of the bearing bodies 10 to permit the manual application of a direct, simple rotational force to the bearing bodies 10. Conceivably, a motor arrangement, such as a servomotor arrangement, could also be used. The two bearing bodies 10 may preferably be connected by cross-members extending across substantially the entire width of the washing device, from one side part 8 to the other, to ensure that the two bearing bodies 10 move in synchronization. Alternatively, the presence of supply roll 3 end take-up roll 5 may be sufficient to ensure, for the purpose of synchronization, the transfer of a rotational displacement from one bearing body 10 to another upon application of a rotational force at one of the bearing bodies 10.

AS shown in FIG. 3, the side-parts 8 may preferably be slidable along direction A so as to either install the washing device into proximity with cylinder 1, or slidably remove the washing device away from proximity with cylinder 1.

One feature of the invention resides broadly in the washing device for a printing machine for removing dirt particles adhering to the outer cylindrical surfaces of the cylinders involved in the printing process comprising a supply roll on which the clean washcloth is wound up, a pressing-on element for pressing the washcloth on the cylinder to be washed, a subsequent take-up roll taking up the dirty washcloth, side parts receiving the rolls and the pressing-on element on both sides thereof, characterized in that the supply roll 3 and the take-up roll 5 are mounted in the side parts 8 so as to be pivotal, in a common center of rotation, about approximately 180°, such that both rolls 3, 5 change working positions so that the empty supply roll 3 is then used to take up the dirty washcloth 2.

Another feature of the invention resides broadly in the washing device characterized in that the two rolls 3, 5 feature coupling means 17, 18 for the drive 20 and, on both sides thereof, said rolls are mounted in a respective bearing body 10 pivot-mounted in the side parts 8, that, when being in a working position, the respective take-up roll 5 may be coupled to the drive mechanism 17–24, and that, with the rolls 3, 5 being in working positions, the bearing bodies 10 may be latched in the side parts 8 via pawls 13.

Examples of printing presses, and components therefor, which may be utilized in accordance with the embodiments of the present invention, may be found in the following U.S. Pat. Nos. 5,170,706, which issued to Rodi et al. on Dec. 15, 1992; 5,081,926, which issued to Rodi on Jan. 21, 1992; and 5,010,820, which issued to Löffler on Apr. 30, 1991.

Examples of various components associated with a washing device, such as a washing medium dispenser, an arrangement for per, hitting sliding installation of a washing device in a printing press, and an arrangement for advancing washcloth, may be found in the following U.S. Pat. Nos. 5,105,740, which issued to Loos et al. on Apr. 21, 1992; and 4,344,361, which issued to MacPhee et al. on Aug. 17, 1982.

An example of a pressing arrangement, and a diaphragm arrangement associated therewith, which may be utilized in accordance with the embodiments of the present invention, may be found in the aforementioned U.S. Pat. No. 5,105,740.

Finally, other examples of various components associated with washing devices, which may be utilized in accordance with the embodiments of the present invention, may be found in the following U.S. Pat. Nos. 4,981,078, which issued to Dettinger et al. in January 1991; 4,757,763, which issued to MacPhee et al. in July 1988; 3,800,702, which issued to Roberts in April 1974; and 3,785,286, which issued to Giori in January 1974.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications end publications recited herein, and in the Declaration attached hereto, are hereby incorporated by reference as if set forth in their entirety herein.

The corresponding foreign patent publication applications, namely, Federal Republic of Germany Patent Application No. P 43 19 258.0, filed on Jun. 9, 1993, having inventors Derlay Krause, and DE-OS P 43 19 258.0 and DE-PS P 43 19 258.0, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS (FIGS. 1 AND 2)

1 cylinder
2 washcloth
3 supply roll
4 pressing-on element
5 take-up roll
6 diaphragm part
7 washing-medium dispenser device
8 side part
9 rail-type guide
10 bearing body
11 holding means
12 center of rotation
13 pawl
14 retention pin
15 axle journal
16 axle journal
17 claw
18 one-way clutch
19 drive Journal
20 advancing means
21 piston rod
22 lever
23 journal
24 swivelling lever
25 bearing
26 machine side frame

What is claimed is:

1. A printing press comprising:

a frame;

a plate cylinder being rotatably mounted on said frame;

an ink reservoir for holding a supply of ink;

an inking mechanism for transferring the ink between said ink reservoir and said plate cylinder during operation of said printing press;

said inking mechanism comprising a plurality of inking rollers for transferring ink from said ink reservoir to said plate cylinder;

a blanket cylinder being rotatably mounted on said frame and having means for being engaged with said plate cylinder during operation of said printing press;

means for washing a predetermined one of the following cylinders and rollers:

said blanket cylinder;

said plate cylinder; and one of said inking rollers;

each of said blanket cylinder, said plate cylinder, and said plurality of inking rollers having an external surface;

said washing means comprising:

a holding location for accommodating an initial supply of washcloth and holding the supply of washcloth at said holding location, the washcloth for being applied to the external surface of the predetermined cylinder or roller, for washing the external surface of the predetermined cylinder or roller;

means for paying out washcloth from said holding location;

means for applying washcloth, having been paid out from said holding location, onto the external surface of the predetermined cylinder or roller, to wash the external surface of the predetermined cylinder or roller;

a receiving location for receiving washcloth, having been paid out from said holding location and having been applied to the external surface of the predetermined cylinder or roller, and for accumulating the received washcloth at said receiving location so as to wrap the received washcloth in a roll;

means for shifting a predetermined portion of the received washcloth, while wrapped in a roll that has been accumulated at said receiving location, from said receiving location to a different location;

means for providing accessibility of said predetermined portion of received washcloth at said different location, to permit removal of said predetermined portion of received washcloth from said washing mean;

first accommodating means, for accommodating, at said holding location, a first roll arrangement having an initial supply of washcloth;

second accommodating means, for accommodating, at said receiving location, a second roll arrangement for accumulating received washcloth by rolling up the received washcloth;

said shifting means comprising means for selectively positioning said second accommodating means between said receiving location and said different location;

said means for positioning said second accommodating means comprising means for positioning said first accommodating means between said holding location and said receiving location simultaneously with the positioning of said second accommodating means between said receiving location and said different location;

said different location is said holding location, such that said means for positioning said second accommodating means is configured for simultaneously:

displacing said second accommodating means between said receiving location and said holding location, whereupon said second accommodating means is accessible to permit removal of the predetermined portion of washcloth from said washing means; and displacing said first accommodating means between said holding location and said receiving location;

said second accommodating means is configured for accommodating, upon removal of the predetermined portion of washcloth from said second accommodating means at said holding location, a further roll arrangement having a new supply of washcloth; and said first accommodating means is configured, when at said receiving location, and upon accommodation of a new supply roll of washcloth by said second accommodating means, for receiving washcloth paid out from said second accommodating means.

2. The printing press according to claim 1, wherein:

said means for simultaneously rotationally displacing said first accommodating means and said second accommodating means comprises means for simultaneously rotationally displacing said first accommodating means and said second accommodating means about a common center of rotation; and said substantial angle of rotational displacement is a rotational displacement of about 180° with respect to said common center of rotation.

3. The printing press according to claim 2, wherein:

said washing means comprises a first side portion and a second side portion;

said first accommodating means comprises:

means, disposed in said first side portion, for accommodating a first end of a given roll arrangement;

means, disposed in said second side portion, for accommodating a second end of the given roll arrangement;

said second accommodating means comprises:

means, disposed in said first side portion, for accommodating a first end of a different given roll arrangement;

means, disposed in said second side portion, for accommodating a second end of the different given roll arrangement;

said applying means comprises:

means for pressing washcloth onto the outer surface of the predetermined cylinder or roller;

said pressing means comprising diaphragm means and means for supporting said diaphragm means;

said diaphragm means being configured for pressing against the washcloth;

said supporting means being supported by, and extending between, said first side portion and said second side portion;

said paying-out means comprises:

linear displacement means;

said linear displacement means having a rod portion and means for linearly displacing said rod portion;

said rod portion having a free end;

lever means being pivotally connected at said free end of said rod portion;

said lever means being pivotally displaceable in response to linear displacement of said rod portion;

said lever means having a first portion and a second portion, wherein said lever means is pivotally connected to said rod portion and said first portion of said lever means;

journal means extending from said second portion of said lever means;

said journal means being rotationally displaceable in response to pivotal displacement of said lever means;

said journal means having a first portion and a second portion;

said journal means being connected to said lever means at said first portion of said journal means;

swivelling lever means connected to said second portion of said journal means;

said swivelling lever means being pivotally displaceable in response to rotational displacement of said journal means;

said swivelling lever means having a first portion and a second portion;

said swivelling lever means being connected to said journal means at said first portion of said swivelling lever means;

pin means extending from said second portion of said swivelling lever means;

said pin means being angularly displaceable, with respect to a center of rotation defined by said journal means, in response to pivotal displacement of said swivelling lever means;

said first and second side portions comprising means for permitting sliding installation of said washing means in said printing press;

each of said first accommodating means and said second accommodating means comprising:

an axle journal for transmitting rotational displacement to a roll accommodated by the respective one of said first and second accommodating means;

claw means for embracing said pin means and for undergoing angular displacement in direct response to angular displacement of said pin means;

said claw means being embraceable about said pin means upon positioning of the respective one of said first and second accommodating means in said receiving position and installation of said washing means in said printing press;

one-way means, connected with said claw means, for:

converting angular displacement of said claw means into rotational displacement of said axle journal upon angular displacement of said claw means in a first rotational direction, with the result that washcloth is paid out from said holding location;

causing said axle journal to remain stationary, upon angular displacement of said claw means in a second, opposite rotational direction, with the result that washcloth is not paid out from said holding location;

said means for simultaneously displacing said first and second accommodating means comprising:

a first bearing body being rotatably mounted in said first side portion;

a second bearing body being rotatably mounted in said second side portion; and said first and second bearing bodies each being rotatable about said common center of rotation;

said washing means further comprises at least one pawl means, and at least one retention pin for being engaged with said at least one pawl means, for locking said first and second bearing bodies in place with respect to said first and second side portions, to hold said first and second accommodating means in position for conducting a washing operation.

4. The printing press according to claim 1, wherein said means for positioning said second accommodating means comprises means for simultaneously rotationally displacing said first accommodating means and said second accommodating means with respect to one another through a substantial angle of rotational displacement.

5. A washing apparatus for a printing press, for washing a predetermined one of the following cylinders and rollers: a blanket cylinder in a printing press, a plate cylinder in a printing press, and one of a plurality of inking rollers in a printing press; each of the blanket cylinder, the plate cylinder, and the plurality of inking rollers having an external surface; said washing apparatus comprising:

means for attaching said washing apparatus to a printing press, the printing press having a substantial area rendering removal of solid cleaning means from said washing apparatus substantially inaccessible;

a substantially self-contained arrangement;

means for holding a supply of solid cleaning means within said substantially self-contained arrangement, which cleaning means is for being applied to the external surface of the predetermined cylinder or roller in a printing press, for cleaning the external surface of the predetermined cylinder or roller;

means for transporting the solid cleaning means from said holding means to the predetermined cylinder or roller in a printing press;

means for applying the solid cleaning means, having been transported from said holding means, onto the external surface of the predetermined cylinder or roller of the printing press, to clean the external surface of the predetermined cylinder or roller;

means for receiving cleaning means having been transported from said holding means and having been applied to the external surface of the predetermined cylinder or roller of the printing press, said receiving means being disposed within said substantially self-contained arrangement;

means for permitting said receiving means to be accessible, upon receipt of a predetermined portion of said cleaning means by said receiving means, to permit removal, from the printing press, of said predetermined portion of said cleaning means directly from said receiving means; and said means for permitting said receiving means to be accessible comprising means for moving said holding means and said receiving means with respect to one another, within said substantially self-contained arrangement.

6. The washing apparatus according to claim 5, wherein the solid cleaning means comprises washcloth, and further wherein:

said holding means comprises means for accommodating an initial supply of washcloth, at a holding location, and holding the supply of washcloth at said holding location;

said transporting means comprises means for paying out washcloth from said holding location; and said receiving means comprises means for:

receiving, at a receiving location, washcloth having been paid out from said holding location and having been applied to the external surface of the predetermined roller or cylinder; and accumulating the received washcloth at said receiving location so as to wrap the received washcloth in a roll.

7. The washing apparatus according to claim 6, wherein said moving means comprises means for shifting a predetermined portion of the received washcloth, while wrapped in a roll that has been accumulated at said receiving location, from said receiving location to a different location.

8. The washing apparatus according to claim 7, wherein:

said holding means comprises first accommodating means, for accommodating, at said holding location, a first roll arrangement having an initial supply of washcloth;

said receiving means comprises second accommodating means, for accommodating, at said receiving location, a second roll arrangement for accumulating received washcloth by rolling up the received washcloth; and said shifting means comprises means for selectively positioning said second accommodating means between said receiving location and said different location.

9. The washing apparatus according to claim 8, wherein said means for positioning said second accommodating means comprises means for positioning said first accommodating means between said holding location and said receiving location simultaneously with the positioning of said second accommodating means between said receiving location and said different location.

10. The washing apparatus according to claim 9, wherein:

said different location is said holding location, such that said means for positioning said second accommodating means is configured for simultaneously:

displacing said second accommodating means between said receiving location and said holding location, whereupon said second accommodating means is accessible to permit removal of the predetermined portion of washcloth from said washing apparatus; and displacing said first accommodating means between said holding location and said receiving location.

11. The washing apparatus according to claim 10, wherein:

said second accommodating means is configured for accommodating, upon removal of the predetermined portion of washcloth from said second accommodating means at said holding location, a further roll arrangement having a new supply of washcloth; and said first accommodating means is configured, when at said receiving location, and upon accommodation of a new supply roll of washcloth by said second accommodating means, for receiving washcloth paid out from said second accommodating means.

12. The washing apparatus according to claim 11, wherein said means for positioning said second accommodating means comprises means for simultaneously rotationally displacing said first accommodating means and said second accommodating means about a common center of rotation, through a rotational displacement of about 180° with respect to said common center of rotation.

13. The washing apparatus according to claim 12, wherein:

said substantially self-contained arrangement comprises a first side portion and a second side portion;

said first accommodating means comprises:

means, disposed in said first side portion, for accommodating a first end of a given roll arrangement;

means, disposed in said second side portion, for accommodating a second end of the given roll arrangement; and said second accommodating means comprises:

means, disposed in said first side portion, for accommodating a first end of a different given roll arrangement;

means, disposed in said second side portion, for accommodating a second end of the different given roll arrangement.

14. The washing apparatus according to claim 13, wherein:

said applying means comprises:

means for pressing washcloth onto the outer surface of the predetermined cylinder or roller;

said pressing means comprising diaphragm means and means for supporting said diaphragm means;

said diaphragm means being configured for pressing against the washcloth;

said supporting means being supported by, and extending between, said first side portion and said second side portion;

said paying-out means comprises:

linear displacement means;

said linear displacement means having a rod portion and means for linearly displacing said rod portion;

said rod portion having a free end;

lever means being pivotally connected at said free end of said rod portion;

said lever means being pivotally displaceable in response to linear displacement of said rod portion;

said lever means having a first portion and a second portion, wherein said lever means is pivotally connected to said rod portion and said first portion of said lever means;

journal means extending from said second portion of said lever means;

said journal means being rotationally displaceable in response to pivotal displacement of said lever means;

said journal means having a first portion and a second portion;

said journal means being connected to said lever means at said first portion of said journal means;

swivelling lever means connected to said second portion of said journal means;

said swivelling lever means being pivotally displaceable in response to rotational displacement of said journal means;

said swivelling lever means having a first portion and a second portion;

said swivelling lever means being connected to said journal means at said first portion of said swivelling lever means;

pin means extending from said second portion of said swivelling lever means;

said pin means being angularly displaceable, with respect to a center of rotation defined by said journal means, in response to pivotal displacement of said swivelling lever means;

said first and second side portions comprising means for permitting sliding installation of said washing apparatus in said printing press;

each of said first accommodating means and said second accommodating means comprising:

an axle journal for transmitting rotational displacement to a roll accommodated by the respective one of said first and second accommodating means;

claw means for embracing said pin means and for undergoing angular displacement in direct response to angular displacement of said pin means;

said claw means being embraceable about said pin means upon positioning of the respective one of said first and second accommodating means in said receiving position and installation of said washing apparatus in said printing press;

one-way means, connected with said claw means, for:

converting angular displacement of said claw means into rotational displacement of said axle journal upon angular displacement of said claw means in a first rotational direction, with the result that washcloth is paid out from said holding location;

causing said axle journal to remain stationary, upon angular displacement of said claw means in a second, opposite rotational direction, with the result that washcloth is not paid out from said holding location;

said means for simultaneously displacing said first and second accommodating means comprising:

a first bearing body being rotatably mounted in said first side portion;

a second bearing body being rotatably mounted in said second side portion; and said first and second bearing bodies each being rotatable about said common center of rotation; and said washing apparatus further comprises at least one pawl means, and at least one retention pin for being engaged with said at least one pawl means, for locking said first and second bearing bodies in place with respect to said first and second side portions, to hold said first and second accommodating means in position for conducting a washing operation.

15. Method of operating a printing press, such a printing press comprising: a frame; a plate cylinder being rotatably mounted on the frame; an ink reservoir for holding a supply of ink; an inking mechanism for transferring the ink between the ink reservoir and the plate cylinder during operation of the printing press; the inking mechanism comprising a plurality of inking rollers for transferring ink from the ink reservoir to the plate cylinder; and a blanket cylinder being rotatably mounted on the frame and having means for being engaged with the plate cylinder during operation of the printing press; said method comprising the steps of:

providing a frame;

providing a plate cylinder and rotatably mounting the same on the frame;

providing an ink reservoir for holding a supply of ink;

providing an inking mechanism for transferring the ink between the ink reservoir and the plate cylinder during operation of the printing press;

said step of providing the inking mechanism comprising the step of providing a plurality of inking rollers for transferring ink from the ink reservoir to the plate cylinder;

providing a blanket cylinder and rotatably mounting the same on the frame;

said step of providing the blanket cylinder comprising the step of providing means for being engaged with the plate cylinder during operation of the printing press;

providing means for washing a predetermined one of the following cylinders and rollers:

the blanket cylinder;

the plate cylinder; and one of the inking rollers;

configuring each of the blanket cylinder, the plate cylinder, and the plurality of inking rollers to have a external surface;

said step of providing the washing means comprising the steps of:

providing a substantially self-contained arrangement;

providing a holding location, within the substantially self-contained arrangement, for accommodating an initial supply of washcloth and for holding the supply of washcloth at the holding location, the washcloth for being applied to the external surface of the predetermined cylinder or roller, for washing the external surface of the predetermined cylinder or roller;

providing means for paying out washcloth from the holding location;

providing means for applying washcloth, having been paid out from the holding location, onto the external surface of the predetermined cylinder or roller, to wash the external surface of the predetermined cylinder or roller;

providing a receiving location, within the substantially self-contained arrangement, for receiving washcloth, having been paid out from the holding location and having been applied to the external surface of the predetermined cylinder or roller, and for accumulating the received washcloth at the receiving location so as to wrap the received washcloth in a roll;

providing first accommodating means, for accommodating, at the holding location, a first roll arrangement having an initial supply of washcloth;

providing second accommodating means, for accommodating, at the receiving location, a second roll arrangement for accumulating received washcloth by rolling up the received washcloth;

providing means for shifting a predetermined portion of the received washcloth, while wrapped in a roll that has been accumulated at the receiving location, from the receiving location to a different location within the substantially self-contained arrangement;

said step of providing shifting means comprising the step of providing means for moving the first accommodating means and the second receiving means with respect to one another, within the substantially self-contained arrangement; and providing means for providing accessibility of the predetermined portion of received washcloth at the different location, to permit removal of the predetermined portion of received washcloth from the washing means;

said method further comprising the additional steps of:

washing a predetermined one of the following cylinders and rollers:

the blanket cylinder;

the plate cylinder; and one of the inking rollers;

said washing step comprising the steps of:

accommodating an initial supply of washcloth, and holding the supply of washcloth at the holding location;

paying out washcloth from the holding location with the means for paying out;

with the applying means, applying washcloth, having been paid out from the holding location, onto the external surface of the predetermined cylinder or roller, to wash the external surface of the predetermined cylinder or roller;

receiving washcloth, having been paid out from the holding location and having been applied to the external surface of the predetermined cylinder or roller, at the receiving location;

accumulating the received washcloth at the receiving location so as to wrap the received washcloth in a roll;

shifting, with the shifting means, a predetermined portion of the received washcloth, while wrapped in a roll that has been accumulated at the receiving location, from the receiving location to a different location;

said shifting step comprising the step of moving the first accommodating means and the second accommodating means with respect to one another, within the substantially self-contained arrangement; and accessing, by way of the means for providing accessibility, the predetermined portion of received washcloth at the different location, and subsequently removing the predetermined portion of received washcloth from the washing means.

16. The method according to claim 15, further comprising the steps of:

said step of providing the shifting means comprising providing means for selectively positioning the second accommodating means between the receiving location and the different location;

said step of accommodating an initial supply of washcloth comprises accommodating, at the holding location, with the first accommodating means, a first roll arrangement having an initial supply of washcloth;

said step of receiving washcloth comprises the step of accommodating, at the receiving location, with the second accommodating means, a second roll arrangement for accumulating received washcloth, and accumulating received washcloth by rolling up the received washcloth; and said step of moving the first accommodating means and the second accommodating means with respect to one another comprises the step of displacing the second accommodating means from the receiving location to the different location.

17. The method according to claim 16, further comprising:

configuring the means for positioning the second accommodating means comprises means for positioning the first accommodating means between the holding location and the receiving location simultaneously with the positioning of the second accommodating means between the receiving location and the different location; and simultaneously with said step of displacing the second accommodating means from the receiving location to the different location, displacing the first accommodating means between the holding location and the receiving location.

18. The method according to claim 17, further comprising the step of configuring the printing press such that:

the different location is the holding location, such that the means for positioning the second accommodating means is configured for simultaneously:

displacing the second accommodating means between the receiving location and the holding location, whereupon the second accommodating means is accessible to permit removal of the predetermined portion of washcloth from the washing means; and displacing the first accommodating means between the holding location and the receiving location;

the second accommodating means is configured for accommodating, upon removal of the predetermined portion of washcloth from the second accommodating means at the holding location, a further roll arrangement having a new supply of washcloth;

the first accommodating means is configured, when at the receiving location, and upon accommodation of a new supply roll of washcloth by the second accommodating means, for receiving washcloth paid out from the second accommodating means;

the means for positioning the second accommodating means comprises means for simultaneously rotationally displacing the first accommodating means and the second accommodating means about a common center of rotation, through a rotational displacement of about 180° with respect to the common center of rotation;

the washing means comprises a first side portion and a second side portion; the first accommodating means comprises:

means, disposed in the first side portion, for accommodating a first end of a given roll arrangement;

means, disposed in the second side portion, for accommodating a second end of the given roll arrangement;

the second accommodating means comprises:

means, disposed in the first side portion, for accommodating a first end of a different given roll arrangement;

means, disposed in the second side portion, for accommodating a second end of the different given roll arrangement;

the applying means comprises:

means for pressing washcloth onto the outer surface of the predetermined cylinder or roller;

the pressing means comprising diaphragm means and means for supporting the diaphragm means;

the diaphragm means being configured for pressing against the washcloth;

the supporting means being supported by, and extending between, the first side portion and the second side portion; the paying-out means comprises:

linear displacement means;

the linear displacement means having a rod portion and means for linearly displacing the rod portion;

the rod portion having a free end;

lever means being pivotally connected at the free end of the rod portion;

the lever means being pivotally displaceable in response to linear displacement of the rod portion;

the lever means having a first portion and a second portion, wherein the lever means is pivotally connected to the rod portion and the first portion of the lever means;

journal means extending from the second portion of the lever means;

the journal means being rotationally displaceable in response to pivotal displacement of the lever means;

the journal means having a first portion and a second portion;

the journal means being connected to the lever means at the first portion of the journal means;

swivelling lever means connected to the second portion of the journal means;

the swivelling lever means being pivotally displaceable in response to rotational displacement of the journal means;

the swivelling lever means having a first portion and a second portion;

the swivelling lever means being connected to the journal means at the first portion of the swivelling lever means;

pin means extending from the second portion of the swivelling lever means;

the pin means being angularly displaceable, with respect to a center of rotation defined by the journal means, in response to pivotal displacement of the swivelling lever means;

the first and second side portions comprising means for permitting sliding installation of the washing means in the printing press;

each of the first accommodating means and the second accommodating means comprising:

an axle journal for transmitting rotational displacement to a roll accommodated by the respective one of the first and second accommodating means;

claw means for embracing the pin means and for undergoing angular displacement in direct response to angular displacement of the pin means;

the claw means being embraceable about the pin means upon positioning of the respective one of the first and second accommodating means in the receiving position and installation of the washing means in the printing press;

one-way means, connected with the claw means, for:

converting angular displacement of the claw means into rotational displacement of the axle journal upon angular displacement of the claw means in a first rotational direction, with the result that washcloth is paid out from the holding location;

causing the axle journal to remain stationary, upon angular displacement of the claw means in a second, opposite rotational direction, with the result that washcloth is not paid out from the holding location;

the means for simultaneously displacing the first and second accommodating means comprising:

a first bearing body being rotatably mounted in the first side portion;

a second bearing body being rotatably mounted in the second side portion; and the first and second bearing bodies each being rotatable about the common center of rotation;

the washing means further comprises at least one pawl means, and at least one retention pin for being engaged with the at least one pawl means, for locking the first and second bearing bodies in place with respect to the first and second side portions, to hold the first and second accommodating means in position for conducting a washing operation.

* * * * *

UNITED STATES PATENT AND TRADEMARK OFFICE

CERTIFICATE OF CORRECTION

PATENT NO. : 5,537,924

DATED : July 23, 1996

INVENTOR(S) : Detlev KRAUSE

It is certified that error appears in the above-indentified patent and that said Letters Patent is hereby corrected as shown below:

On the title page, item [75], before 'Krause,', delete "Detley" and insert --Detlev--.

On the title page, item [56], under the "U.S. PATENT DOCUMENTS" section, after '5/1990', delete "Nazaka" and insert --Nozaka--.

In column 2, line 23, after 'being', delete "rot drably" and insert --rotatably--.

In column 2, line 23, after 'the', delete "free;" and insert --frame;--.

In column 3, line 31, after 'the', delete "free" and insert --frame--.

In column 3, line 35, after the second occurrence of 'the', delete "free;" and insert --frame;--.

In column 6, line 17, after 'pivots', delete "e" and insert --a--.

--

UNITED STATES PATENT AND TRADEMARK OFFICE

CERTIFICATE OF CORRECTION

PATENT NO. : 5,537,924

DATED : July 23, 1996

INVENTOR(S) : Detlev KRAUSE

It is certified that error appears in the above-indentified patent and that said Letters Patent is hereby corrected as shown below:

In column 8, line 63, after 'inventors', delete "Derlay" and insert --Detlev--.

In column 10, line 31, Claim 1, after 'washing', delete "mean;" and insert --means;--.

In column 11, line 4, Claim 2, after 'claim', delete "1," and insert --4,--.

Signed and Sealed this

Twenty-fourth Day of December, 1996

*Attest:*

Bruce Lehman

BRUCE LEHMAN

*Attesting Officer*

*Commissioner of Patents and Trademarks*